US005570472A

United States Patent [19]

Dicker

[11] Patent Number: 5,570,472

[45] Date of Patent: Nov. 5, 1996

[54] RESISTANT EXERCISE SHIRT AND PANTS

[76] Inventor: Timothy P. Dicker, 11359 Dornfield, Lake View Terrace, Calif. 91342

[21] Appl. No.: 554,733

[22] Filed: Nov. 7, 1995

[51] Int. Cl.[6] ..... A41D 1/08

[52] U.S. Cl. ..... 2/69; 2/79; 2/227

[58] Field of Search ..... 2/69, 227, 79, 2/228, 238, 170, 108, 115, 102; 482/105, 121, 124, 131, 74; 450/104

[56] References Cited

U.S. PATENT DOCUMENTS

| | | | |
|---|---|---|---|
| 4,325,379 | 4/1982 | Ozbey | 450/104 |
| 4,910,802 | 3/1990 | Malloy . | |
| 4,953,856 | 9/1990 | Fox, III . | |
| 4,961,573 | 10/1990 | Wehrell . | |
| 4,968,028 | 11/1990 | Wehrell . | |
| 4,993,705 | 2/1991 | Tölle . | |
| 5,046,194 | 9/1991 | Alaniz et al. . | |
| 5,062,642 | 11/1991 | Berry et al. . | |
| 5,109,546 | 5/1992 | Dicker . | |
| 5,186,701 | 2/1993 | Wilkinson . | |
| 5,201,074 | 4/1993 | Dicker . | |
| 5,267,928 | 12/1993 | Barile et al. . | |
| 5,282,277 | 2/1994 | Onozawa . | |
| 5,308,305 | 5/1994 | Romney . | |
| 5,357,637 | 10/1994 | Moore . | |
| 5,367,708 | 11/1994 | Fujimoto . | |
| 5,383,235 | 1/1995 | Peters . | |

*Primary Examiner*—C. D. Crowder
*Assistant Examiner*—Glona Hale
*Attorney, Agent, or Firm*—Cislo & Thomas

[57] ABSTRACT

A resistive exercise suit has a resistive shirt and resistive exercise trousers. The resistive exercise shirt uses tension bands on sleeve fronts and backs and attachment to central elastic blocks on the front and back of the shirt. Both the tension bands and the elastic blocks are incorporated into the shirt and provide means by which resistance can be made against arm movements. Thumb stirrups form the sleeve ends and serve as means by which the hands may engage the tension bands and apply resistance against the arms and their muscles. The tension bands may be adjustably attached to the elastic blocks. The thumb stirrups may also be adjustable. Front and back flaps form an adjustably attachable shirttail that may pass between the wearer's legs in order to ensure a snug and secure fit of the resistive exercise shirt to the wearer. Connection of the front and back flaps ensure that the resistive exercise shirt does not ride up on the wearer. The resistive exercise trousers fit snugly upon the wearer and have adjustable suspenders and stirrups. The stirrups pass about the feet of the wearer and apply tension to the resistive exercise trousers in conjunction with the adjustable suspenders. Vertical resistive panels running along the length of each pant leg of the resistive exercise trousers serve to resist the motion of the leg in any direction. Motion of the leg requires greater muscular effort and serve to tone and develop the muscles of the leg.

15 Claims, 4 Drawing Sheets

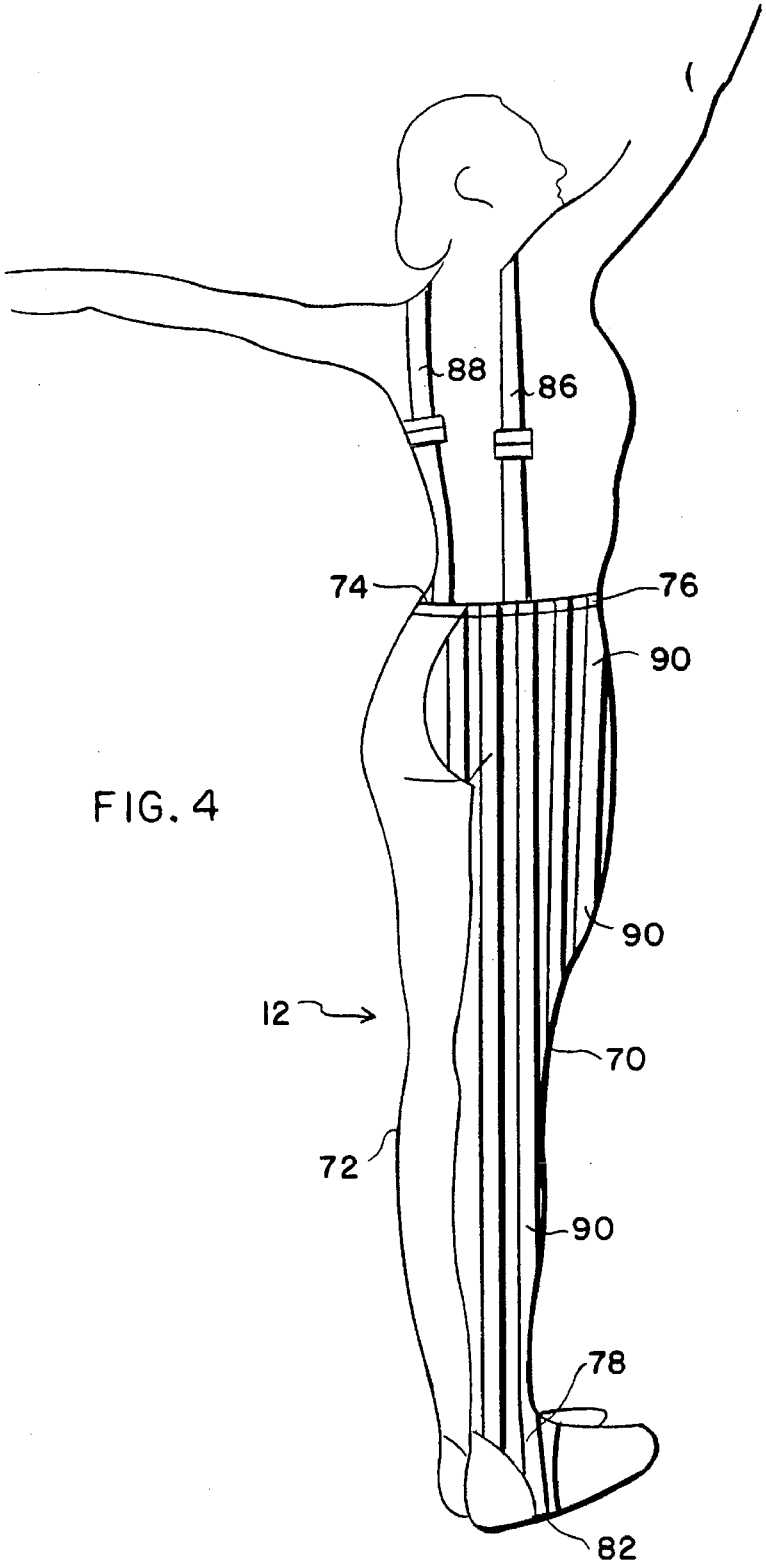
FIG. 4
FIG. 5
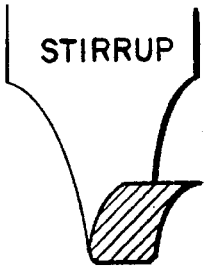

RESISTANT EXERCISE SHIRT AND PANTS

BACKGROUND OF THE INVENTION

1. Field of the Invention

This invention relates to clothing worn in conjunction with exercise and, more particularly, to clothing that augments muscular activity by restraining the limbs.

2. Description of the Related Art

Exercise forms a natural part of a healthy lifestyle, and in the recent past much emphasis has been placed upon aerobic activity in order to provide better health, avoid fatigue, and generally enhance one's well-being. While aerobic activity provides an excellent means by which to enhance cardiovascular functioning, muscular development is often neglected. Resort generally must be made to weight training in order to provide muscular development. Due to the lack of muscular development when engaging in aerobic activity, many persons are deprived of the benefits of muscular development when they engage in such aerobic activity.

In order to address such shortcomings, previous attempts have been made to provide garments that restrain muscular movement in order to enhance and increase muscular activity when the limbs and body are moved. Some known attempts in this direction are briefly described below.

E. A. Malloy, U.S. Pat. No. 4,910,802

This patent is directed to an exercise suit. This patent provides for a number of what are termed "conduits," for example, a chest conduit 17. The chest conduit 17 includes an encircling elastic band for securing and maintaining a predetermined pressure to the chest of the wearer of the suit 10. The patent also provides for elastic bands adjustably secured by buckles 29, allowing adjustment of the tensioning force. The patent also includes leg conduits 25/26, which also provide for elastic bands and adjustment by the buckles 29.

J. W. Romney, U.S. Pat. No. 5,308,305

This patent is directed to a device to augment exercises. Many embodiments are presented; as an example, there is a shoulder harness 120 with two adjustable shoulder assemblies 122/124 having corresponding buckles 126/128. An elongated resistance member 90 is adjustably attached to buckle 131; and the shoulder assembly 124 has a loop 132 attached, which secures the buckle 134. There is a pant-leg garment 10, which includes the passageways 14/16. Resistance member 30 is threaded through the opening 20/passageway 14 and may be formed from some type of elastic webbing or cord.

M. Fujimoto, U.S. Pat. No. 5,367,708

This patent is directed to a wearing article for wearing in pressed relation to the human body. A number of articles used in the invention are shown in FIGS. 1–9. Specifically, in FIG. 1, a shirt is shown which is formed of a stretchable cloth and extends from each shoulder to the upper arm portions. The stretchable cloth 1 is used in various orientations to provide reinforcement to the muscles.

S. Onozawa, U.S. Pat. No. 5,282,277

This patent is directed to a body cover for outdoor use. There are stirrups 12, shown in FIGS. 1–3 for the body cover 2. The material used for the anterior area 14 as well as the posterior area 16 and the lateral area 18 is stated to have elastic properties which allow the body cover 2 to be relatively tight fitting and allow free body movement.

C. E. Fox, III, U.S. Pat. No. 4,953,856

This patent is directed to an exercise garment which uses weights in various sections of the garment. In FIG. 4, where the weight element 207 is shown, a pouch is filled with some sort of weight. The weight 207 has attachment means 211 and may include mechanical snaps 213.

SUMMARY OF THE INVENTION

The present invention resides in resistant exercise shirt and pants that can be considered as making up a resistant exercise suit. The shirt portion of the resistant exercise suit has an elastic block on the front and back to which tension bands are attached. The tension bands are coupled to the hands of the wearer by means thumb stirrups. The attachment between the elastic blocks and the tension bands are likewise adjustable. The tension bands run the length of the sleeves' front and back. By resisting the extension of the arms, the muscles of the arms are required to work against the restraining force and allowed to develop during exercise. The adjustable nature of the tension bands and the restraining force allows each individual to set the constraint at that level which is most preferred. In order to keep the shirt portion snug with respect to the wearer's torso, front and back flaps are used that connect between the wearer's legs so that the shirttail of the shirt portion is not loose and does not release the constraint on the arms imposed by the tension bands.

The trouser portion of the resistant exercise suit has pant legs along which resistant panels (much like the tension bands of the: shirt portion) run. At the ends of each of the pant legs, a stirrup engages the wearer's foot and provides the lower point of attachment. Near the waistband of the trouser portion, a pair of suspenders provides the upper point of attachment and holds the trousers in tension with respect to the stirrups. When the wearer flexes his or her legs, the resistant panels constrain the leg movements; and the muscles of the legs must overcome the resistance. In so doing, the muscles of the legs are taxed and must exert more force in order to move normally. By adjusting the suspenders and the stirrups, the wearer can select that tension which is most preferred when using trouser portion of the suit.

When worn in conjunction with each other, the trouser portion and the shirt portion form a resistant exercise suit that develops the wearer's muscles as the wearer engages in aerobic exercise.

OBJECTS OF THE INVENTION

It is an object of the present invention to provide resistant exercise garments that serve to develop limb muscles when extended or flexed.

It is also an object of the present invention to provide a resistant exercise suit that resists muscular movement.

It is another object of the present invention to provide such a resistant exercise suit that is adjustable.

It is yet another object of the present invention to provide a resistant exercise shirt that uses tension bands in conjunction with elastic blocks in order to restrain and develop the arms.

It is yet another object of the present invention to provide a pair of resistive exercise trousers having vertical, resistive panels that restrain and thereby develop the legs.

These and other objects and advantages of the present invention will be apparent from a review of the following specification and accompanying drawings.

BRIEF DESCRIPTION OF THE DRAWINGS

FIG. 4 shows a side rear view of the resistive exercise trousers when worn by a person.

FIG. 5 shows a side view of a stirrup portion present in the resistive exercise trousers of the present invention.

DESCRIPTION OF THE PREFERRED EMBODIMENT(S)

Figure 1:
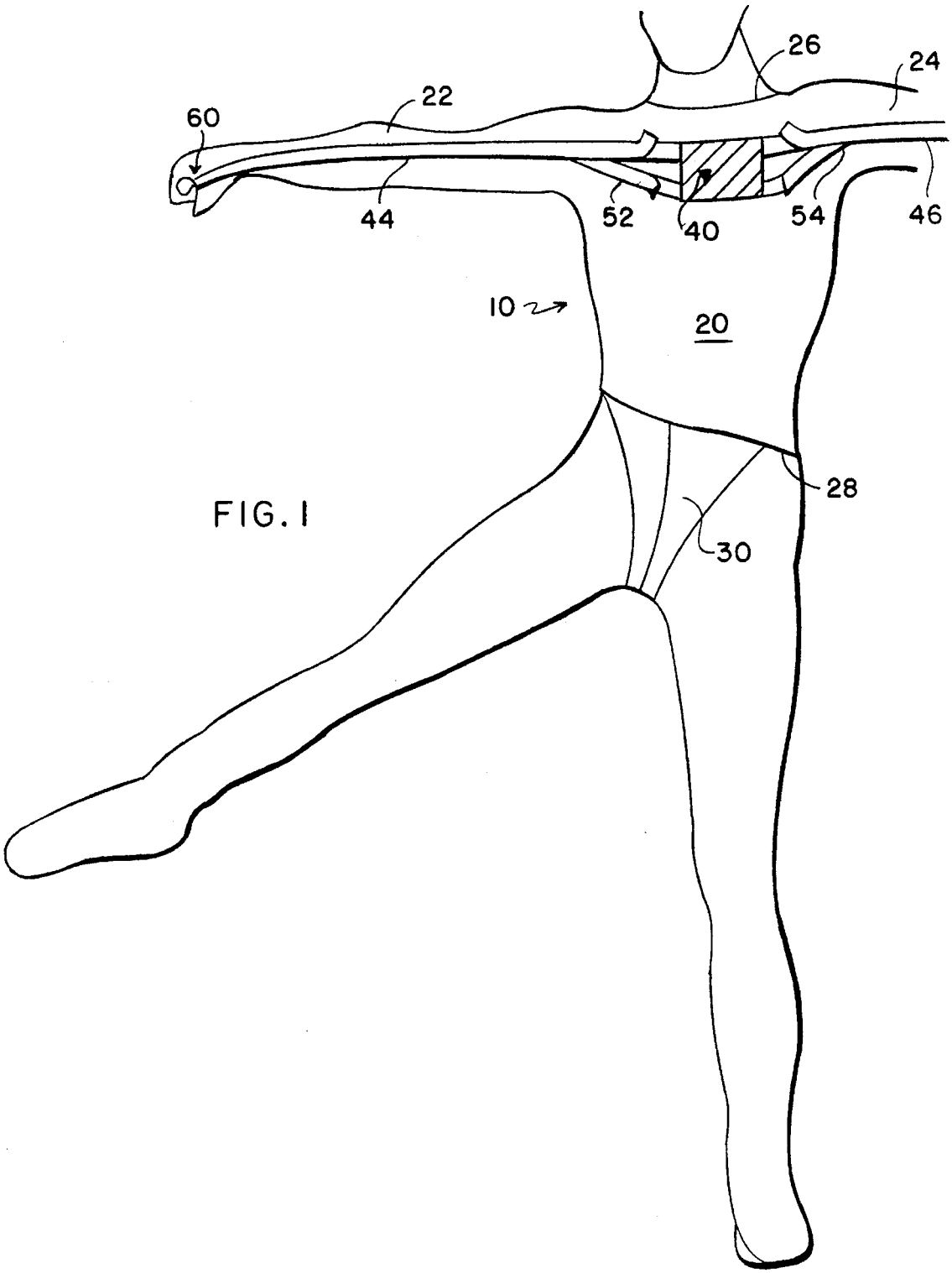
FIG. 1 shows a front view of the resistive exercise shirt of the present invention when worn by a person.

The resistive exercise suit of the present invention has a top, or shirt, portion 10 and a bottom, or trouser, portion 12. Both the shirt 10 and trouser 12 portions resist the extending and flexing of the limbs so as to provide muscular development for them. Such development can easily occur when the wearer is engaged in aerobic exercise or the like. The resistive exercise shirt 10 has a shirt portion 20 that has sleeves 22, 24. An opening for the neck 26 and the torso 28 are present. At the lowermost portions of the resistive exercise shirt 10, front 30 and rear 32 flaps are present that hold the shirt down and snug with respect to the wearer's body.

The material used to construct the shirt portion 20 of the shirt 10 should be very breathable and resilient. The fabric should be breathable so that vigorous exercise is not unpleasant when the shirt 10 is worn. Likewise, the fabric should stretch in order to allow the wearer great freedom of movement. Such materials include cotton, or any other flexible and breathable material such as those marketed under the trade names of LYCRA®, SPANDEX®, or the like. Combinations of such materials may also be used.

Figure 2:
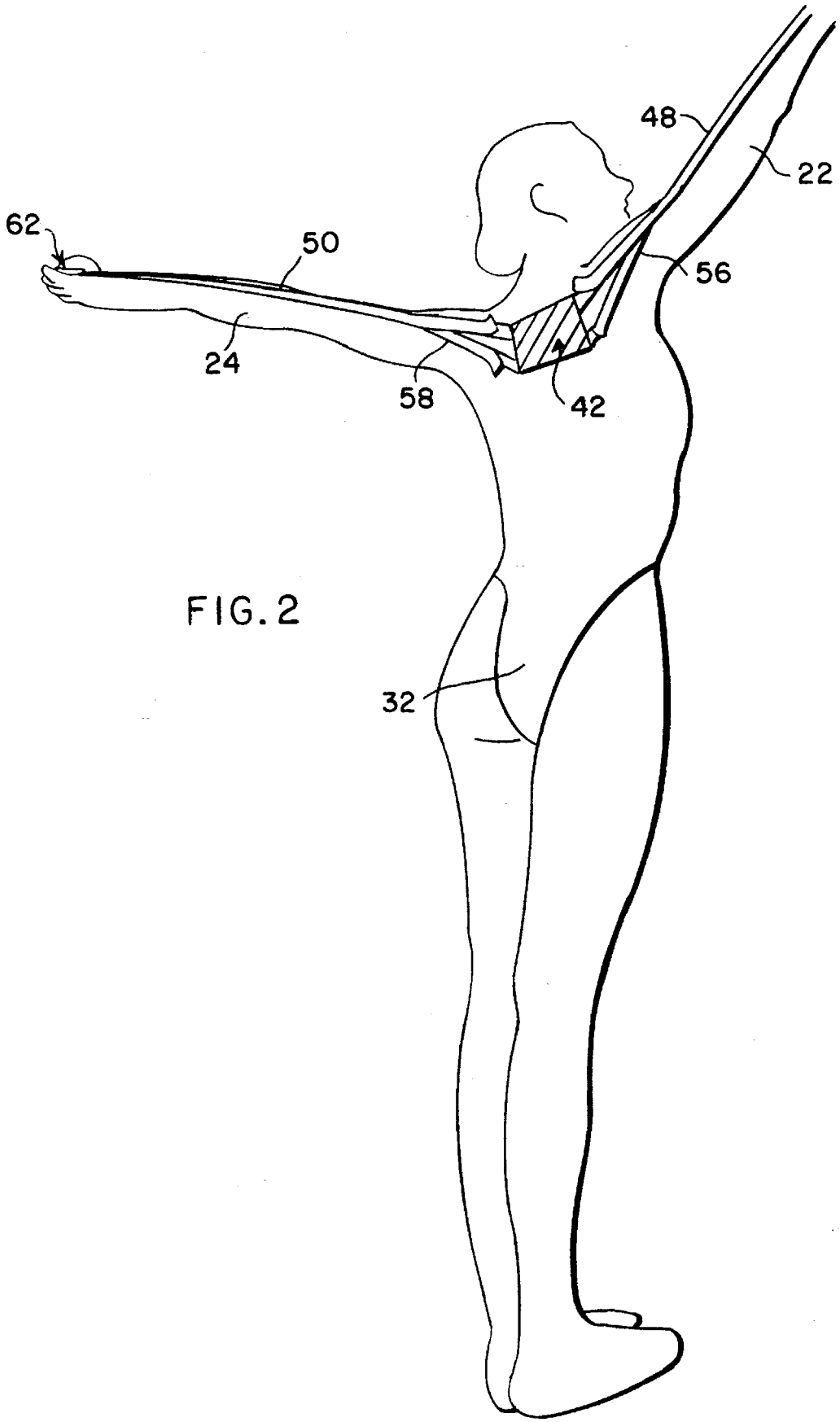
FIG. 2 shows a rear view of the resistive exercise shirt when worn by a person.

In the present invention, blocks of elastic material are incorporated into the shirt portion 20 of the shirt 10 between the shoulders of the wearer. As shown in FIGS. 1 and 2, a front elastic block 40 and a rear elastic block 42 are shown. The blocks are generally centrally located between the shoulders of the wearer so as to provide uniform and central access to the blocks. The blocks 40, 42 are made of resilient and elastic material and may include means by which they may be attached to other portions of the present invention. In an alternative embodiment of the present invention, the elastic blocks 40 and 42 may be replaceable by blocks having either greater or lesser resilience so as to provide greater or lesser restraint upon the wearer's arms. Various forms of dense and flexible plastics may compose the material used in the elastic blocks 40, 42; however, the specific material used in the elastic blocks 40, 42 is not so important as is the flexible response of the elastic blocks 40, 42 to the pulling stress imposed upon them by the tension bands.

Attached to the flexible blocks 40, 42 are tension bands extending the length of the sleeves 22, 24. The right front tension band 44 extends the length of the front of the right sleeve 22. The left front tension band 46 extends the length of the front of the left sleeve 24. Right back 48 and left back 50 tension bands extend the length of the corresponding sleeve portions. The tension bands are shown in FIGS. 1 and 2.

In order to better attach themselves to the elastic blocks 40, 42, the tension bands 44, 46, 48, 50 split into forked portions adjacent the blocks 40, 42. As an example, the right front tension band 44 splits into a forked portion 52 in order to provide better attachment to the front elastic block 40. The same is similarly true for the left front 54, right back 56, and left back 58 forks. Having such forks allows distribution of the stress that arises when the wearer flexes the arms. Such stress is then better distributed over the elastic blocks 40, 42 and provides better performance for the resistive shirt 10.

The tension bands are made of resiliently elastic material in order to provide some resistance to the arms but transmit the flexing and extending motion of the arms primarily to the elastic blocks 40, 42. It can be seen that the tension bands may be made of the same material as the elastic blocks 40, 42; and such construction provides an easier form of construction as fewer different materials are required.

The tension bands 44, 46, 48, 50 may be attached by a variety of means to the elastic blocks 40, 42. Such attachment means may include the following: buttons, snaps, hook-and-loop tape, or any other adjustable form of attachment to the elastic blocks 40, 42. While it is possible to permanently attach the tension bands to the elastic blocks, such permanent attachment does not allow for adjustability.

At the distal ends of the tension bands 44, 46, 48, 50, thumb stirrups 60, 62 give the tension bands means by which they may be attached to the furthermost portion of the wearer's arms. The thumb stirrups 60, 62 may be separate elements attached to the end of sleeves 22, 24, respectively. Alternatively, the thumb stirrups 60, 62 are continuous with the adjacent tension bands so that the tension bands form a continuous loop from the front elastic block 40 to the rear elastic block 42. In this case, the right front 44 and right back 48 tension bands are interconnected by the right thumb stirrup 60; and the left front 46 and left back 50 tension bands are continuously attached by the left thumb stirrup 62. The thumb stirrups 60, 62 extend past the end of the sleeves 22, 24, respectively, so a gap is present through which the wearer's thumbs may pass. In the preferred embodiment of the thumb stirrups, the thumb stirrups 60, 62 may be made adjustable as by hook-and-loop tape, snaps, and/or buttons or the like so that the tension upon the tension bands 44, 46, 48, 50 may be adjusted between the thumbs of the wearer and the front and rear elastic blocks 40, 42.

In order to use the resistive exercise shirt 10 of the present invention, the wearer first slips the head through the torso opening 28, then the neck opening 26. The corresponding arms are slipped through the right 22 and left 24 sleeves. The shirt is then adjusted so that it fits comfortably upon the upper body of the wearer. The lower portion of the shirt adjacent the torso opening is adjusted for greatest comfort before the front and rear flaps 30, 32 are attached to one another as by snaps, buttons, or the like. The attachment between the tension bands 44, 46, 48, 50 and the front and rear elastic blocks 40, 42, may then be adjusted for the wearer's preferences. The thumb stirrups are engaged by the wearer's thumbs and, if adjustable, connected so as to provide thumb stirrups according to the wearer's tension preferences.

Upon donning and adjusting the resistive exercise shirt 10 of the present invention, extending movements of the arm are resisted by the front 44, 46 tension bands and back 48, 50 tension bands. As the arms are moved forward and away from the wearer's body, the back 48, 50 tension bands are stretched, applying force upon the rear elastic block 42. The thumb stirrups hold the sleeves 22, 24 relatively in place with minimal slippage. Likewise, when the arms are moved back and away from the wearer's body, the front 44, 46 tension bands are stretched and transmit the stretching to the front elastic block 40. As both forward and backward arm movements are resisted by the tension bands 44, 46, 48, 50, the muscles of the arms are developed by engaging the arms in aerobic activity and other movement. Extended wear of the resistive exercise shirt 10 serves to develop the arm muscles, and such development is enhanced by associated aerobic activity.

Due to the construction and fabrics used in the resistive exercise shirt 10, it may be easily washed and dried and used repeatedly. Once the tension bands have been adjusted, readjustment may not be necessary.

Figure 3:
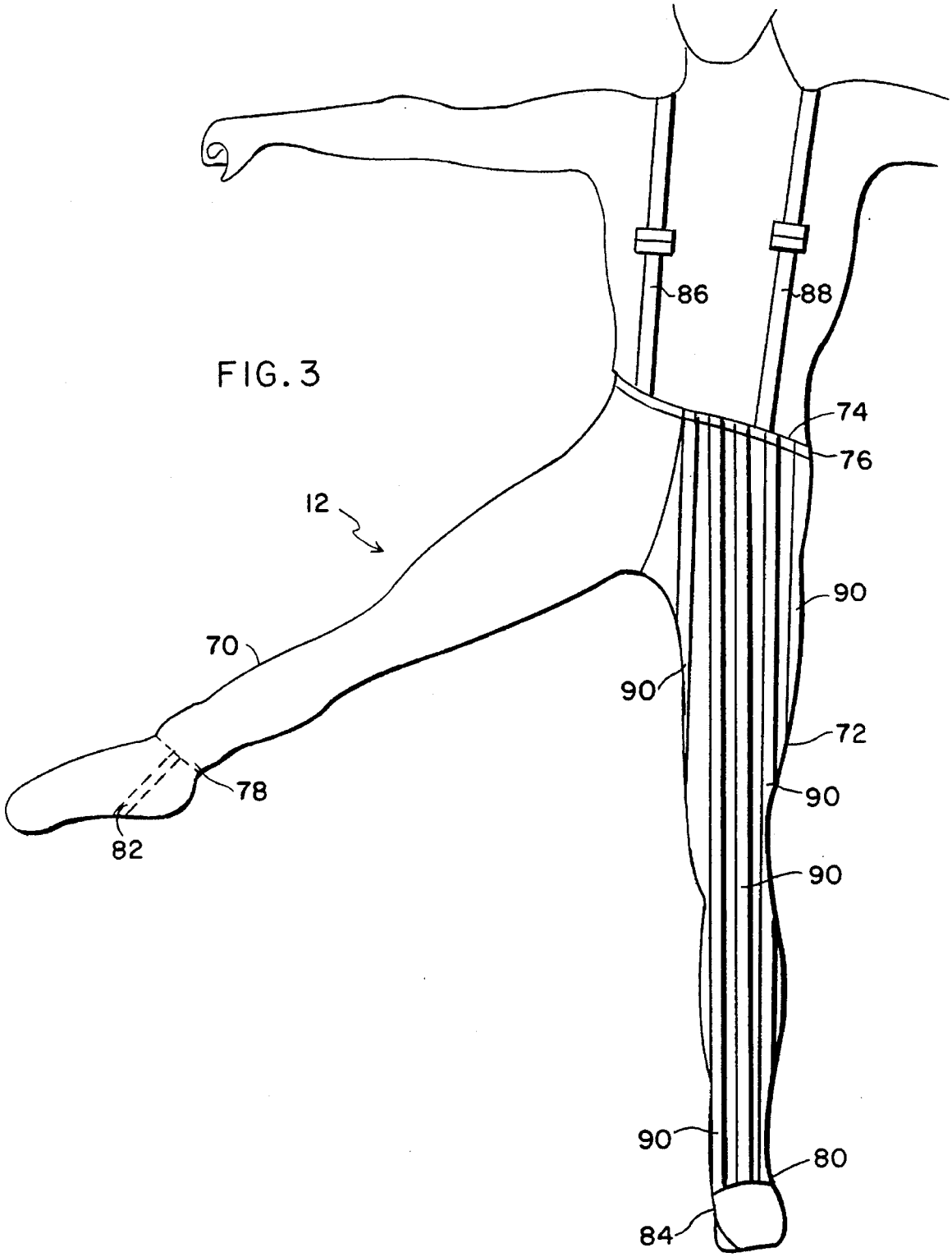
FIG. 3 shows a front view of the resistive trousers when worn by a person.

The resistive exercise trousers 12 of the present invention are shown in FIGS. 3 and 4. The resistive exercise trousers 12 generally resemble ordinary trousers and fit closely to the form of the wearer. The trousers 12 have right 70 and left 72 pant legs that extend from the wearer's waist or hip area to the wearer's ankles. A hip or waist opening 74 may be adjacently circumscribed by an elastic waistband 76. Openings 78, 80 are present at the distal ends of the pant legs 70, 72 through which the feet may slip and emerge from the ends of the pant legs. Each pant leg 70, 72 has at its end a stirrup 82, 84. These stirrups 82, 84 loop around the bottom of the foot adjacent the ankle or otherwise. Suspenders 86, 88 are attached near the waist opening 74 and support the resistive exercise trousers 12 by looping up and about the shoulders of the wearer, traversing the wearer's torso from front to back. The suspenders 86, 88 may be adjustable as by buckles or the like.

The trousers 12 fit snugly about the wearer's legs and hips. Running vertically along the length of each pant leg are a series of spaced, resistive panels 90. The resistive panels 90 traverse the length of the pant leg from the waist opening 74 to the foot openings 78, 80. The resistive panels are incorporated into the trouser material which may be the same as the material of shirt portion 20. The resistive panels 90 may be of the same material as the tension bands 44, 46, 48, 50 or otherwise and generally serve to resist the flexion motion of the wearer's leg. That is, when the wearer's leg flexes forward, the rear resistive panels serve to resist such motion; and when the wearer's leg flexes backward, the front resistive panels 90 serve to resist such motion. In resisting such motion, the wearer must use the muscles of the leg to overcome such resistance which serves to develop and exercise such muscles.

The stirrups 82, 84 may be adjustable as is partially shown in FIG. 5. The adjustability of the stirrups may achieved by use of buttons, snaps, hook-and-look tape, and other means known in the art. The adjustability of the stirrups 82, 84 serves to allow adjustability of the resistance experienced by the wearer when wearing the resistive trousers 12 of the present invention.

Additionally, the suspenders 86, 88 may also be adjustable so that, between the adjustability of the stirrups 82, 84 and the suspenders 86, 88, the wearer can adjust the resistance experienced while wearing the resistive trousers 12 of the present invention.

To don the resistive trousers 12, the wearer first inserts right and left feet through the pant legs 70, 72, respectively. After the feet have passed through the respective foot openings 78, 80, the stirrups 82, 84 may then be positioned to engage the bottom of the wearer's feet. The trousers 12 are then adjusted to fit comfortably about the lower portion of the wearer's body. The waistband 76 girdles either the wearer's hips or waist according to the wearer's preference. The suspenders 86, 88 are then looped about the wearer's shoulder and adjusted along with the stirrups 82, 84 for the preferred resistance of the wearer. Once all adjustments have been made and the trousers are properly positioned, motion of the legs is resisted by the resistive panels 90 on the opposite side of the leg so that all leg motions must include greater physical effort on the part of the leg muscles, thereby developing and exercising them.

Once the stirrups 82, 84 and suspenders 86, 88 have been adjusted for a particular wearer, readjustment may not be necessary.

When used in conjunction with the resistive exercise shirt 10 of the present invention, the resistive exercise trousers 12 of the present invention serve to form a resistive suit that allows articulating, flexing, and extending of the limbs yet requires greater physical activity thereby increasing strength, endurance, aerobic capacity, and general well-being. The wearer's arms, legs must work harder to overcome the restraints imposed, and even the abdominal muscles may have to work harder.

While the present invention has been described with regard to particular embodiments, it is recognized that additional variations of the present invention may be devised without departing from the inventive concept.

What is claimed is:

1. A resistive exercise shirt, comprising:

a shirt portion having first and second sleeves and defining openings for a neck and a torso;

a first elastic block incorporated into said shirt portion, said first elastic block centrally located on a first side of said shirt portion between said first and second sleeves;

a first tension band incorporated into said first sleeve and traversing the length of said first sleeve, said first tension band connectable to said first elastic block;

a first thumb stirrup connected to said first tension band;

a second tension band incorporated into said second sleeve and traversing the length of said second sleeve, said second tension band connectable to said first elastic block; and a second thumb stirrup connected to said second tension band; whereby a person seeking exercise may don the resistive exercise shirt and connect said first and second tension bands to said first elastic block so as to resist movement of said person's arms, thereby augmenting muscular effort and exercise when said person moves said arms.

2. The resistive exercise shirt of claim 1, further comprising:

a second elastic block incorporated into said shirt portion, said second elastic block centrally located on a second side of said shirt portion between said first and second sleeves:

a third tension band incorporated into said first sleeve and traversing the length of said first sleeve opposite said first tension band, said third tension band connectable to said second elastic block and said first thumb stirrup;

a fourth tension band incorporated into said second sleeve and traversing the length of said second sleeve opposite said second tension band, said fourth tension band connectable to said second elastic block and said second thumb stirrup.

3. The resistive exercise shirt of claim 2, further comprising:

said first tension band being adjustably connectable to said first elastic block;

said first thumb stirrup being adjustable;

said second tension band being adjustably connectable to said first elastic block;

said second thumb stirrup being adjustable;

said third tension band being adjustably connectable to said second elastic block; and said fourth tension band being adjustably connectable to said second elastic block.

4. The resistive exercise shirt of claim 1, further comprising:

attachment means for attaching portions of said shirt portion adjacent said torso opening to said person, said attachment means ensuring a snug fit of the resistive exercise shirt to said person, said portions of said shirt portion adjacent said torso opening held generally in place by said attachment means.

5. The resistive exercise shirt of claim 4, wherein said attachment means further comprises:

front and rear flaps, said front flap adjustably attachable to said rear flap, said front and rear flaps passing between said person's legs and snugly engaging said person to generally hold the resistive exercise shirt in place.

6. The resistive exercise shirt of claim 3, further comprising:

said first tension band continuous with said third tension band and forming said first adjustable thumb stirrup.

7. The resistive exercise shirt of claim 6, further comprising:

said second tension band continuous with said fourth tension band and forming said second adjustable thumb stirrup.

8. A resistive exercise shirt, comprising:

a shirt portion having first and second sleeves and defining openings for a neck and a torso;

a first elastic block incorporated into said shirt portion, said first elastic block centrally located on a first side of said shirt portion between said first and second sleeves;

a second elastic block incorporated into said shirt portion, said second elastic block centrally located on a second side of said shirt portion between said first and second sleeves;

a first tension band incorporated into said first sleeve and traversing the length of said first sleeve, said first tension band adjustably connectable to said first elastic block;

a first adjustable thumb stirrup connected to said first tension band;

a second tension band incorporated into said second sleeve and traversing the length of said second sleeve, said second tension band adjustably connectable to said first elastic block;

a second adjustable thumb stirrup connected to said second tension band;

a third tension band incorporated into said first sleeve and traversing the length of said first sleeve opposite said first tension band, said third tension band adjustably connectable to said second elastic block and said first adjustable thumb stirrup;

a fourth tension band incorporated into said second sleeve and traversing the length of said second sleeve opposite said second tension band, said fourth tension band adjustably connectable to said second elastic block and said second adjustable thumb stirrup; and front and rear flaps, said front flap adjustably attachable to said rear flap, said front and rear flaps passing between a person's legs and snugly engaging said person to generally hold the resistive exercise shirt in place; whereby said person seeking exercise may don the resistive exercise shirt and adjustably connect said first and second tension bands to said first elastic block, said third and fourth tension bands to said second elastic block, and said front flap to said rear flap so that the resistive exercise shirt may resist movement of said person's arms, thereby augmenting muscular effort and exercise when said person moves said arms.

9. The resistive exercise shirt of claim 8, further comprising:

said first tension band continuous with said third tension band and forming said first adjustable thumb stirrup.

10. The resistive exercise shirt of claim 8, further comprising:

said second tension band continuous with said fourth tension band and forming said second adjustable thumb stirrup.

11. A pair of resistive exercise trousers, comprising:

a trouser portion having first and second pant legs and defining openings for a pair of feet and a hip or waist;

first and second suspenders coupled to said trouser portion near said opening for said waist;

a first plurality of resistive bands incorporated into said trouser portion and traversing the length of said first pant leg;

a first stirrup coupled to said first plurality of resistive bands;

a second plurality of resistive bands incorporated into said trouser portion and traversing the length of said second pant leg; and a second stirrup coupled to said second plurality of resistive bands; whereby a person seeking exercise may don the resistive exercise trousers and tension the resistive exercise trousers between said suspenders and said first and second stirrups so as to resist movement os said person's legs, thereby augmenting muscular effort and exercise when said person moves said legs.

12. The pair of resistive exercise trousers of claim 11, further comprising:

said first and second suspenders being adjustable; and said first and second stirrups being adjustable.

13. A resistive exercise suit, comprising:

a shirt portion having first and second sleeves and defining openings for a neck and a torso;

a first elastic block incorporated into said shirt portion, said first elastic block centrally located on a first side of said shirt portion between said first and second sleeves:

a second elastic block incorporated into said shirt portion, said second elastic block centrally located on a second side of said shirt portion between said first and second sleeves;

a first tension band incorporated into said first sleeve and traversing the length of said first sleeve, said first tension band adjustably connectable to said first elastic block;

a first adjustable thumb stirrup connected to said first tension band;

a second tension band incorporated into said second sleeve and traversing the length of said second sleeve, said second tension band adjustably connectable to said first elastic block;

a second adjustable thumb stirrup connected to said second tension band;

a third tension band incorporated into said first sleeve and traversing the length of said first sleeve opposite said first tension band, said third tension band adjustably connectable to said second elastic block and said first adjustable thumb stirrup;

a fourth tension band incorporated into said second sleeve and traversing the length of said second sleeve opposite said second tension band, said fourth tension band adjustably connectable to said second elastic block and said second adjustable thumb stirrup;

front and rear flaps, said front flap adjustably attachable to said rear flap, said front and rear flaps passing between a person's legs and snugly engaging said person to generally hold the resistive exercise shirt in place;

a trouser portion having first and second pant legs and defining openings for a pair of feet and a hip or waist, said trouser portion worn in conjunction with said shirt portion;

first and second adjustable suspenders coupled to said trouser portion near said opening for said waist;

a first plurality of resistive bands incorporated into said trouser portion and traversing the length of said first pant leg;

a first adjustable stirrup coupled to said first plurality of resistive bands;

a second plurality of resistive bands incorporated into said trouser portion and traversing the length of said second pant leg; and a second adjustable stirrup coupled to said second plurality of resistive bands; whereby said person seeking exercise may don the resistive exercise suit and adjustably connect said first and second tension bands to said first elastic block, said third and fourth tension bands to said second elastic block, and said front flap to said rear flap so that the resistive exercise shirt may resist movement of said person's arms, thereby augmenting muscular effort and exercise when said person moves said arms and adjustably tension the resistive exercise trousers between said adjustable suspenders and said first and second adjustable stirrups so as to resist movement os said person's legs, thereby augmenting muscular effort and exercise when said person moves said legs.

14. The resistive exercise shirt of claim 13, further comprising:

said first tension band continuous with said third tension band and forming said first adjustable thumb stirrup.

15. The resistive exercise shirt of claim 13, further comprising:

said second tension band continuous with said fourth tension band and forming said second adjustable thumb stirrup.

* * * * *